US007029207B2

(12) United States Patent
Kim

(10) Patent No.: US 7,029,207 B2
(45) Date of Patent: Apr. 18, 2006

(54) RAPID-SET INJECTION SYSTEM USING HIGH-SPEED JET FLUID

(76) Inventor: Yong-Hyun Kim, 150-104 Old Jugong Apt 1, 2008 Sanbon 2 Dong, Gunpo-City, Kyunggi-Do (KR)

( * ) Notice: Subject to any disclaimer, the term of this patent is extended or adjusted under 35 U.S.C. 154(b) by 0 days.

(21) Appl. No.: 10/850,675

(22) Filed: May 20, 2004

(65) Prior Publication Data

US 2005/0186035 A1 Aug. 25, 2005

(30) Foreign Application Priority Data

May 22, 2003 (KR) ..... 10-2003-0032520

(51) Int. Cl.
*E02D 3/12* (2006.01)
*E02D 5/44* (2006.01)

(52) U.S. Cl. ..... 405/269; 405/266; 405/241

(58) Field of Classification Search ..... 405/233, 405/236, 240, 241, 266–269; 239/403–405
See application file for complete search history.

(56) References Cited

U.S. PATENT DOCUMENTS 3,969,902 A * 7/1976 Ichise et al. ..... 405/267
4,624,606 A * 11/1986 Nakanishi et al. ..... 405/269
4,659,259 A * 4/1987 Reed et al. ..... 405/263
4,786,212 A * 11/1988 Bauer et al. ..... 405/269
4,971,480 A * 11/1990 Nakanishi ..... 405/269
5,141,366 A * 8/1992 Ishida et al. ..... 405/263
5,382,116 A * 1/1995 Nakanishi ..... 405/269
5,704,554 A * 1/1998 Cooper et al. ..... 239/690.1
5,980,446 A * 11/1999 Loomis et al. ..... 405/266
6,120,214 A * 9/2000 Iovino ..... 405/241
6,669,115 B1 * 12/2003 Sun et al. ..... 239/403
6,902,352 B1 * 6/2005 Kim ..... 405/269

FOREIGN PATENT DOCUMENTS

JP 55108518 * 8/1980 ..... 405/269
JP 60126423 * 7/1985 ..... 405/233
JP 02197614 * 8/1990 ..... 405/269
JP 04085412 * 3/1992 ..... 405/266
JP 4089913 * 3/1992 ..... 405/269
JP 06041945 * 2/1994 ..... 405/266

* cited by examiner

*Primary Examiner*—Jong-Suk (James) Lee
(74) *Attorney, Agent, or Firm*—Jordan and Hamburg LLP

(57) ABSTRACT

A rapid-set injection system using high-speed jet fluid for forming a pile-shaped solid body in the ground has an injection rod which does not jam in the ground and which has two or three jet nozzles so that the injection rod linearly excavates the target ground. The injection rod has an excavating bit provided at a lower portion of the injection rod to inject downward a fluid to the outside of the injection rod in criss-crossing diagonal directions, with a drill bit coupled to a lower end of the excavating bit, a first agitating unit mounted to an upper end of the excavating bit to inject desired materials to the outside of the injection rod at different levels in different diagonal directions, and a second agitating unit mounted to an upper end of the first agitating unit to horizontally inject air to the outside of the injection rod.

7 Claims, 6 Drawing Sheets

Fi.g 5A
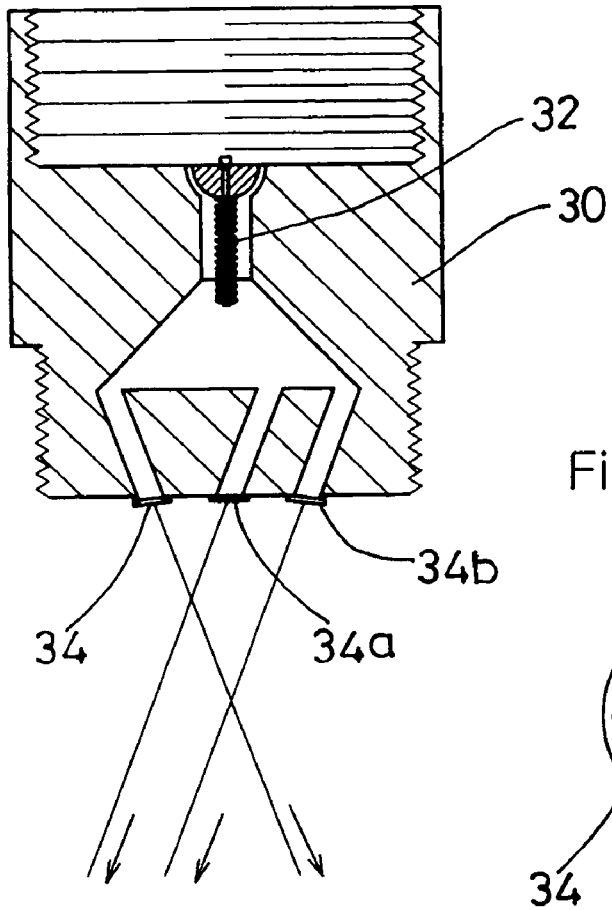
Fig. 5B
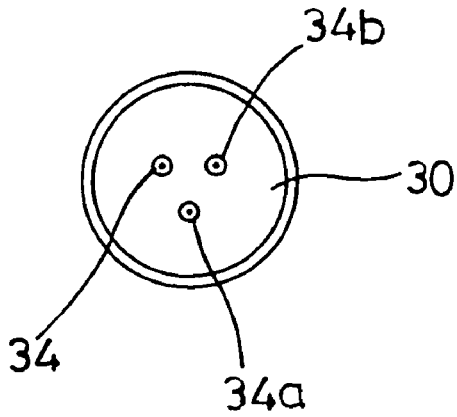

RAPID-SET INJECTION SYSTEM USING HIGH-SPEED JET FLUID

BACKGROUND OF THE INVENTION

1. Field of the Invention

The present invention relates to rapid-set injection systems for improving soft ground, which is used in civil engineering works, and more particularly, to a rapid-set injection system using high-speed jet fluid, in which air, a cement hardening agent and a quick setting agent, respectively introduced along injection paths defined in an injection rod of the injection system inserted in a bore of the ground, are vigorously injected under high pressure to the soft ground, thus improving the soft ground.

2. Description of the Prior Art

In general, a method of improving soft ground is extensively known in the art, in which a monitor inserted in a bore of the ground is rotated and retracted upward while injecting a liquid-phase hardening agent, such as cement milk, thereby providing a pile-shaped solid body in the ground.

The conventional apparatuses using the above-mentioned method of improving the soft ground include a plurality of nozzles which are provided on an injection rod inserted in a bore of the ground. Thus, the liquid-phase hardening agent is injected under high pressure from the nozzles to the soil of the ground having the bore while the injection rod is rotated and retracted upward in the bore, thus improving the ground.

However, in the conventional apparatuses for improving the soft ground, the liquid-phase hardening agent is horizontally injected from the nozzles of the injection rod to the soil of the ground having the bore. Thus, the conventional apparatuses for improving the soft ground do not have desired permeability to evenly crush the soil of the ground, so that the infiltrating region of the hardening agent injected from the apparatuses is not even. Therefore, the conventional apparatus for improving the soft ground is problematic in that the size of the improved region of the ground is reduced, and the properties of the solid bodies formed in the improved ground are uneven.

To solve the above-mentioned problems, an apparatus with inclined nozzles for improving soft ground was proposed. However, in the conventional apparatus with the inclined nozzles, the inclined nozzles are arranged along the injection rod of the apparatus at large intervals. Furthermore, the inclined nozzles, arranged on the injection rod, inject the liquid-phase hardening agent to the ground in regular directions. Therefore, when the ground improvement work is executed in a deep bore of the ground, jamming of the injection rod in the deep bore of the ground may be undesirably caused. Furthermore, the conventional apparatus with the inclined nozzles is problematic in that slime, generated while the apparatus improves the ground, is not easily removed from the bore of the ground, thus disturbing formation of the desired solid bodies in the target ground.

Furthermore, a bit, provided on a lower end of the injection rod, vertically injects downward a fluid to the ground. Therefore, the injection rod may not provide a desired excavating force, so that the injection rod may not linearly move in the bore of the ground.

In addition, because a gel time during a ground improvement work using the apparatus with the inclined nozzles is indicated after the liquid-phase hardening agent is injected to the ground, it is very difficult to form desired solid bodies in the ground under water. Therefore, the conventional apparatus with the inclined nozzles cannot be used in a variety of ground improvement works.

SUMMARY OF THE INVENTION

Accordingly, the present invention has been made keeping in mind the above problems occurring in the prior art, and an object of the present invention is to provide a rapid-set injection system using high-speed jet fluid, which has a structure capable of formation of a pile-shaped solid body in a target ground without causing any jamming of an injection rod of the injection system in the bore even when the ground improvement work using the apparatus is executed in a deep bore of the ground, and which efficiently removes slime generated during the ground improvement work, and which has two or three jet nozzles to increase an excavating force of the injection rod, so that the injection rod linearly moves in the bore of the target ground, and in which the injected hardening agent is rapidly hardened in the ground to quickly set the solid body, thus easily executing the ground improvement work in even the ground under water with a fast current.

In order to accomplish the above object, the present invention provides a rapid-set injection system using high-speed jet fluid, including an injection rod having one or more injection pipes to respectively feed air, a cement hardening agent and a quick setting agent in the injection rod, prior to injecting them to an outside of the injection rod. The injection rod further has an excavating bit provided at a lower portion of the injection rod to inject downward a fluid to the outside of the injection rod in criss-crossing diagonal directions, with a drill bit coupled to a lower end of the excavating bit; a first agitating unit mounted to an upper end of the excavating bit to inject desired materials to the outside of the injection rod at different levels toward different diagonal directions, and a second agitating unit mounted to an upper end of the first agitating unit to horizontally inject air to the outside of the injection rod.

The excavating bit provided at the lower portion of the injection rod may include a check valve provided at a central portion of the excavating bit, and one or more jet nozzles respectively disposed on the lower end of the excavating bit to inject downward the fluid to the outside of the injection rod in the crisscrossing diagonal directions.

The first agitating unit mounted to the upper end of the excavating bit may include an upper twin nozzle provided at an upper portion of the first agitating unit to inject the air and water to the outside of the injection rod in a diagonal direction, and a lower twin nozzle provided under the upper twin nozzle in the first agitating unit to inject the cement hardening agent and the quick setting agent to the outside of the injection rod in another diagonal direction.

The second agitating unit mounted to the upper end of the first agitating unit may include a plurality of horizontal nozzles provided on predetermined portions of an outer casing of the second agitating unit, thus horizontally injecting the air to the outside of the injection rod.

The excavating bit may include a longitudinal excavating bit body, a twisted wing part provided around the longitudinal excavating bit body, and a plurality of twin nozzles provided on predetermined portions of an edge of the twisted wing part to inject the desired materials to the outside of the injection rod in the different diagonal directions.

BRIEF DESCRIPTION OF THE DRAWINGS

The above and other objects, features and advantages of the present invention will be more clearly understood from the following detailed description taken in conjunction with the accompanying drawings, in which:

FIGS. 3A and 3B are views of an upper twin nozzle of the injection rod of FIG. 2, wherein:

FIG. 3A is a front view of the upper twin nozzle of the injection rod of FIG. 2; and FIG. 3B is a side sectional view of the upper twin nozzle of the injection rod of FIG. 2, in which currents of fluid flowing through injection paths of the upper twin nozzle of FIG. 2 and fluid jets injected from the upper twin nozzle are shown;

FIGS. 5A and 5B are views of an excavating bit of the injection rod of FIG. 2, wherein:

FIG. 5A is a sectional view of the excavating bit of the injection rod of FIG. 2, in which directions of water jets injected from a plurality of jet nozzles of the excavating bit are shown; and FIG. 5B is a front view of the excavating bit of the injection rod of FIG. 2;

DETAILED DESCRIPTION OF THE INVENTION

This invention will be described in further detail by way of example with reference to the accompanying drawings.

Figure 1:
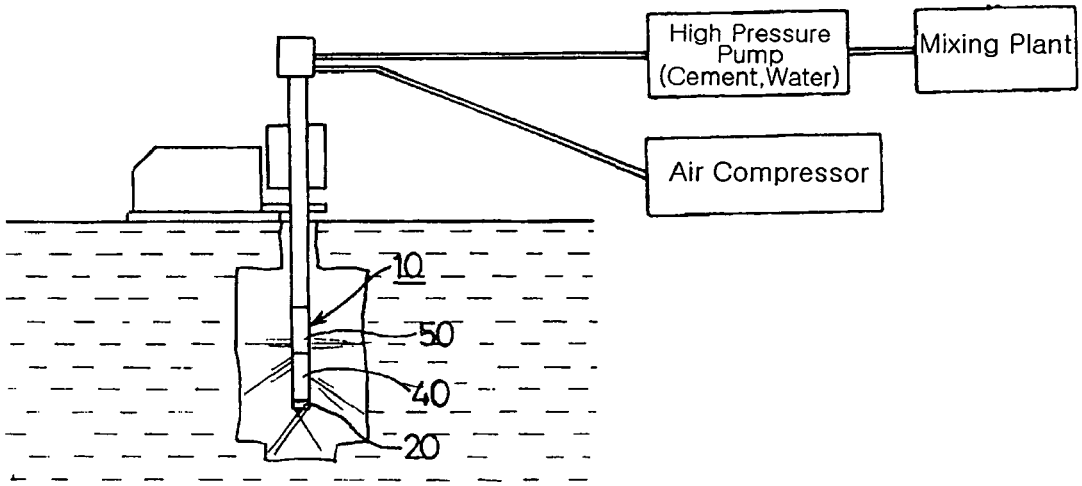
FIG. 1 is a schematic view showing a ground improvement work using an injection rod of a rapid-set injection system, according to a first embodiment of the present invention.
Figure 2:
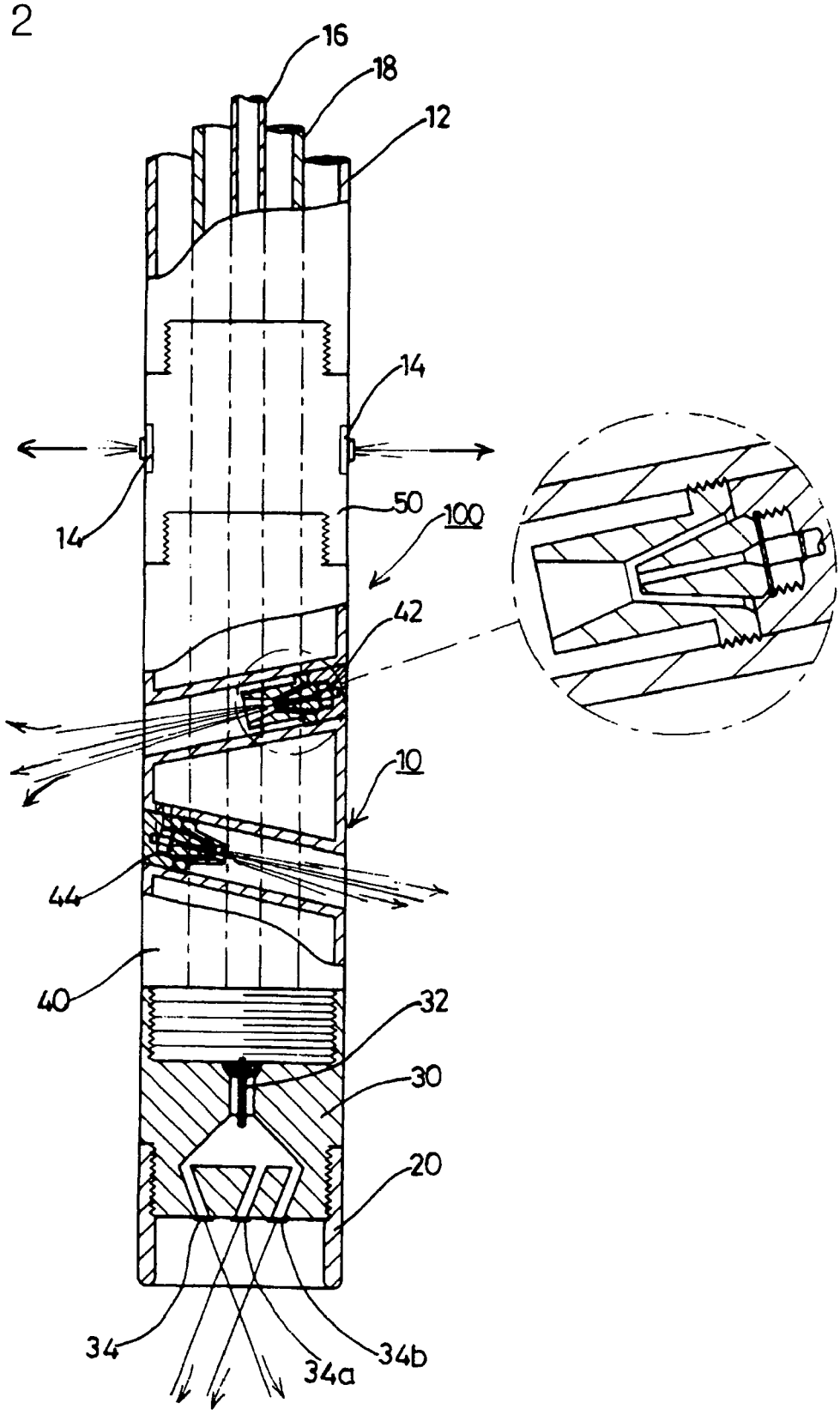
FIG. 2 is a sectional view showing a substantial part of the injection rod of FIG. 1.
Figure 3A:
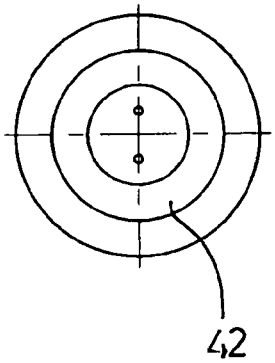
Figure 3B:
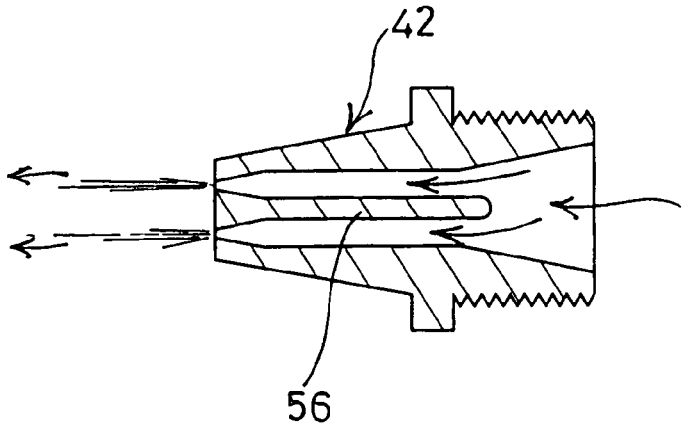
Figure 4:
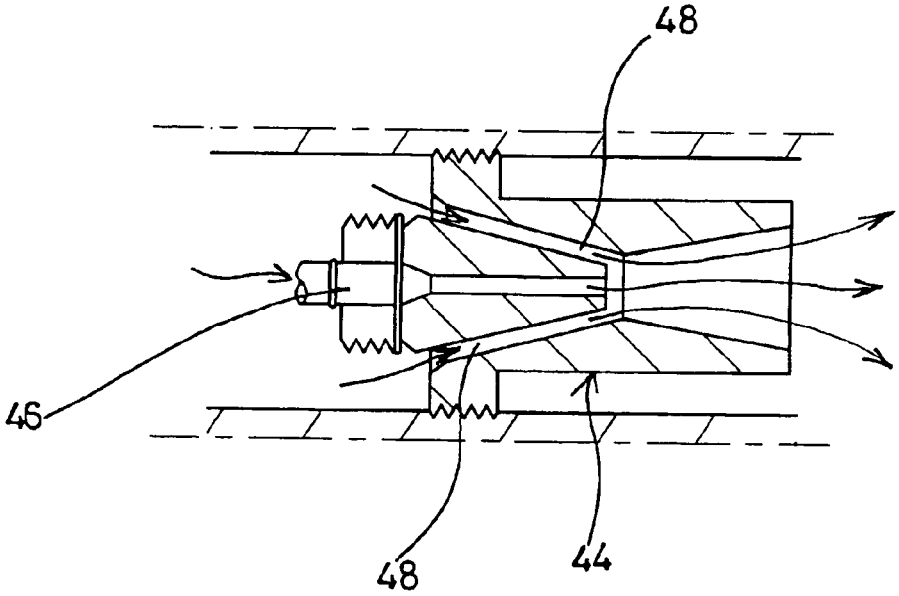
FIG. 4 is a side sectional view of a lower twin nozzle of the injection rod of FIG. 1, in which currents of two kinds of liquids flowing in and injected from the lower twin nozzle are shown.
Figure 6:
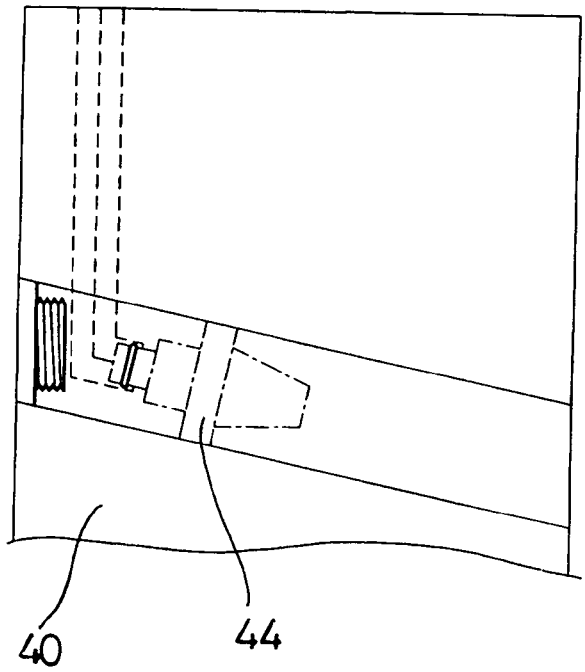
FIG. 6 is a partially schematic view showing the lower twin nozzle of FIG. 4 mounted in a first agitating unit of the injection rod of FIG. 2.
Figure 7:
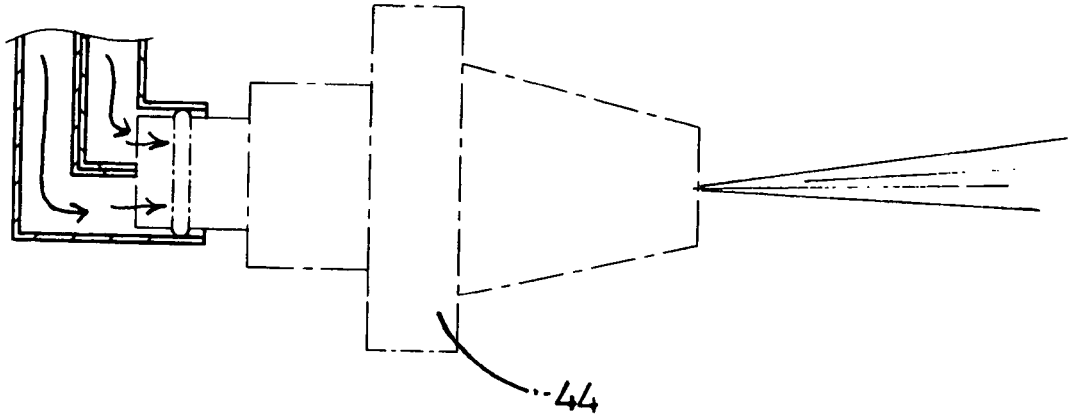
FIG. 7 is a sectional view of the lower twin nozzle of FIG. 4 connected to a predetermined feed pipe in which currents of the two kinds of liquids flowing through two separate paths defined in the feed pipe into the lower twin nozzle are shown.

FIG. 1 is a schematic view showing a ground improvement work using an injection rod 10 of a rapid-set injection system 100, according to a first embodiment of the present invention. FIG. 2 is a sectional view showing a substantial part of the injection rod 10 of FIG. 1. FIGS. 3A and 3B are views of an upper twin nozzle 42 of the injection rod 10 of FIG. 2. FIG. 4 is a side sectional view of a lower twin nozzle 44 of the injection rod 10 of FIG. 1, in which currents of two kinds of liquids flowing in and injected from the lower twin nozzle 42 are shown. FIGS. 5A and 5B are views of an excavating bit 30 of the injection rod 10 of FIG. 2. FIG. 6 is a partially schematic view showing the lower twin nozzle 44 of FIG. 4 mounted in a first agitating unit 40 of the injection rod 10 of FIG. 2. FIG. 7 is a sectional view of the lower twin nozzle 44 of FIG. 4 connected to a predetermined feed pipe in which currents of the two kinds of liquids flowing through two separate paths defined in the feed pipe into the lower twin nozzle 44 are shown.

As shown in FIGS. 1 through 7, the rapid-set injection system 100 using high-speed jet fluid according to the first embodiment of the present invention includes the injection rod 10. The injection rod 10 has an outer casing 12, an outer pipe 18 which is axially provided in the outer casing 12, and an inner pipe 16 which is axially provided in the outer pipe 18, so as to inject air, a cement hardening agent and a quick setting agent to an outside of the injection rod 10. The injection rod 10 includes two horizontal nozzles 14 and 14*a*, the upper twin nozzle 42 and the lower twin nozzle 44 which are respectively provided on an upper, central and lower portions of the outer casing 12 of the injection rod 10. The injection rod 10 further includes the excavating bit 30 which is provided at a lower portion of the injection rod 10. The injection rod 10 further includes a drill bit 20 which is coupled to a lower end of the excavating bit 30.

The excavating bit 30, provided at the lower portion of the injection rod 10, includes one or more jet nozzles 34, 34*a* and 34*b* which are respectively disposed on the lower end of the excavating bit 30 to inject downward a fluid to the outside of the injection rod 30 in crisscrossing diagonal directions. The excavating bit 30 further includes a check valve 32 which is provided at a central portion of the excavating bit 30 to control the flowing of the fluid, supplied to the jet nozzles 34, 34*a* and 34*b* of the excavating bit 30, in response to a pressure difference between both sides of the check valve 32.

That is, the check valve 32 is closed when the pressure of the fluid is higher than a predetermined reference pressure, thus stopping the supply of the fluid to the jet nozzles 34, 34*a* and 34*b*.

The injection rod 10 further includes a first agitating unit 40 which is mounted to an upper end of the excavating bit 30 to inject desired materials to the outside of the injection rod 30 at different levels in different diagonal directions. The upper twin nozzle 42 is provided at an upper portion of the first agitating unit 40 to inject the air and water or the air and a hardening agent to the outside of the injection rod 10 in a diagonal direction. The lower twin nozzle 44 is provided under the upper twin nozzle 42 in the first agitating unit 40 to inject the cement hardening agent and the quick setting agent to the outside of the injection rod 10 in another diagonal direction. In the system 100 of the present invention, the hardening agent injected from the upper twin nozzle 42 is different from the cement hardening agent injected from the lower twin nozzle 44.

The upper twin nozzle 42 has therein two injection paths defined by a partition body 56, thus injecting the air and water or the air and hardening agent through the two injection paths to the outside of the injection rod 10. The lower twin nozzle 44 has a central path 46 which is axially defined through a center of the lower twin nozzle 44 to inject the cement hardening agent, and a pair of inclined outside paths 48 which are provided around the central path 46 to converge with the central path 46 at an outside end of the lower twin nozzle 44. The inclined outside paths 48 inject the quick setting agent to the outside of the injection rod 10.

The injection rod 10 further includes a second agitating unit 50 which is mounted to an upper end of the first agitating unit 40 to horizontally inject the air to the outside of the injection rod 10.

The two horizontal nozzles 14 and 14*a* are provided on predetermined portions of the outer casing 12 of the second agitating unit 50, thus horizontally injecting the air to the outside of the injection rod 10.

Figure 8:
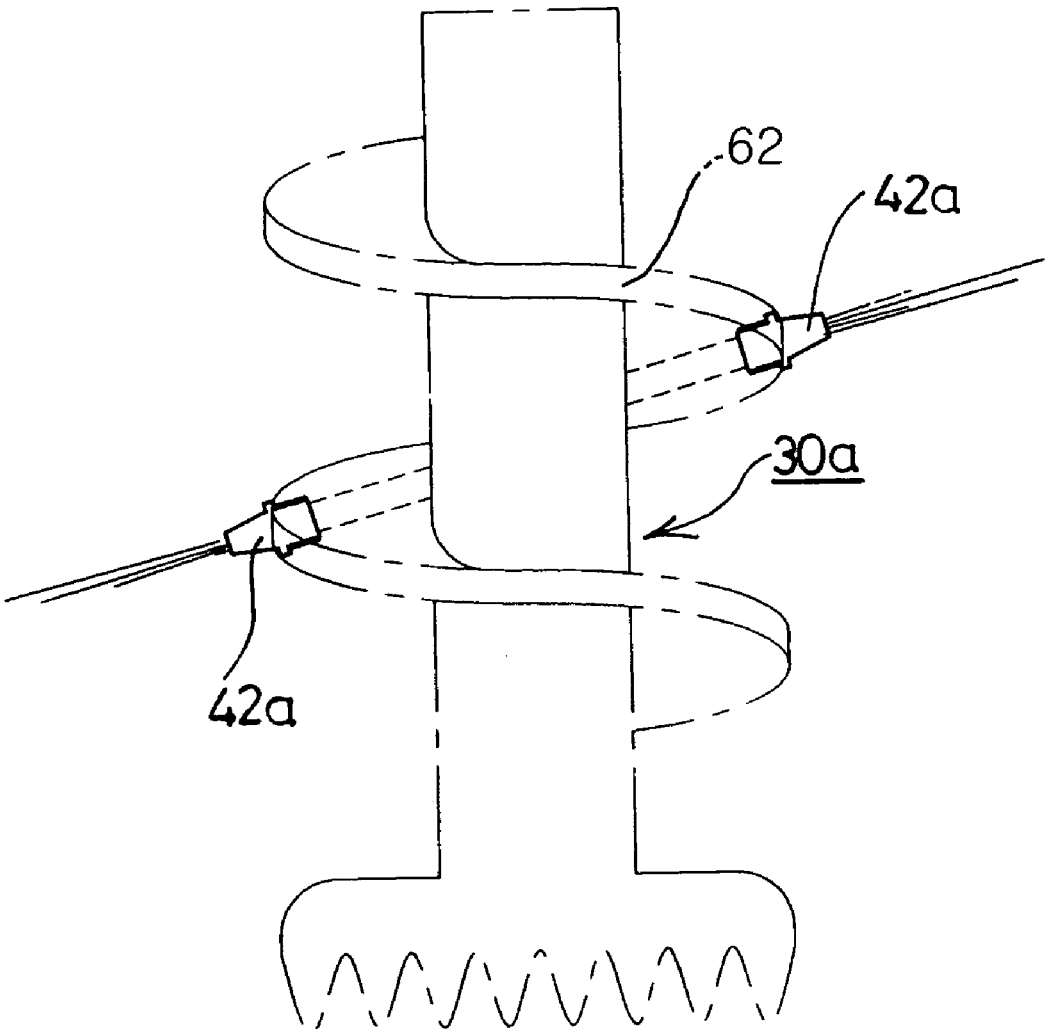
FIG. 8 is a front view of an excavating bit of a rapid-set injection system, according to a second embodiment of the present invention, in which a plurality of twin nozzles are mounted on an edge of a twisted wing part of a longitudinal excavating bit body.

FIG. 8 is a front view of an excavating bit 30*a* of a rapid-set injection system 100, according to a second embodiment of the present invention, in which a plurality of twin nozzles 42*a* are mounted on an edge of a twisted wing part 62 of a longitudinal excavating bit body.

As shown in FIG. 8, the excavating bit 30*a* constituting the injection rod 10 of the injection system 100 according to the second embodiment of the present invention includes the longitudinal excavating body, with the twisted wing part 62 provided around the longitudinal excavating bit body. The plurality of twin nozzles 42*a* are provided on predetermined portions of the edge of the twisted wing part 62 to inject the desired materials to the outside of the injection rod 10 in the different diagonal directions.

During a ground improvement work using the injection system 100 according to the present invention, the target ground is rapidly improved by high pressure fluid jets injected from the injection rod 10 of the injection system 100. Therefore, the injection system 100 according to the present invention is efficiently used in a water stop work.

In the injection system 100 of the present invention, the excavating bit 30 and the drill bit 20 are sequentially mounted to the lower portion of the injection rod 10 through a screw-type assembling, as shown in FIG. 2. Therefore, when the target ground is improved by the injection rod 10 of the injection system 100, the drill bit 20 is in close contact with the target ground while the plurality of jet nozzles 34, 34*a* and 34*b* of the excavating bit 30 inject downward the fluid to the ground. Thus, the injection rod 10 rapidly excavates downward the ground during the above-mentioned excavating process of the injection rod 10, and thereby easily forming a bore in the ground.

At this time, the plurality of jet nozzles 34, 34*a* and 34*b*, disposed on the lower end of the excavating bit 30, vigorously inject the fluid to the ground in the criss-crossing diagonal directions. Thus, the injection rod 10 is rotated during its excavating process. That is, the fluid jets, injected from the jet nozzles 34, 34*a* and 34*b*, are inclined relative to a longitudinal axis of the injection rod 10 at angles of 1° or higher. Therefore, injection rod 10 rotates by the fluid jets injected from the jet nozzles 34, 34*a* and 34*b*, and thus the excavating force of the injection rod 10 is increased by the rotating force of the injection rod 10. Furthermore, the injection rod 10 linearly excavates the ground during the rotation of the injection rod 10.

Thereafter, the fluid injection of the jet nozzles 34, 34*a* and 34*b* is stopped by an operation of the check valve 32 of the excavating bit 30, when the pressure of the fluid supplied into the jet nozzles 34, 34*a* and 34*b* is higher than the predetermined reference pressure. The upper twin nozzle 42 of the first agitating unit 40, thereafter, injects the air and water to the soil around the bore of the target ground to horizontally excavate the ground around the bore.

After the above-mentioned horizontal excavating process of the upper twin nozzle 42 is completed, the hardening agent is supplied into the injection rod 10. The upper twin nozzle 42 of the first agitating unit 40, thereafter, injects the hardening agent into an upper portion of the ground around the bore, thus forming a pile-shaped solid body in the ground. At this time, because the hardening agent is vigorously injected from the upper twin nozzle 42 under high pressure, the solid body is rapidly formed in the ground. Therefore, the injection system 100 of the present invention can be used in a ground improvement work to improve the ground under water with a fast current, such as the water stop work.

During the ground improvement work, the lower twin nozzle 44 injects the cement hardening agent and the quick setting agent into a lower portion of the ground having the bore, while the upper twin nozzle 42 injects the hardening agent into the upper portion of the ground. Thus, the pile-shaped solid body is formed in the ground, without failure.

As described above, the upper twin nozzle 42, which injects the hardening agent into the upper portion of the target ground having the bore, and the lower twin nozzle 44, which injects the cement hardening agent and the quick setting agent into the lower portion of the target ground, are respectively provided in the first agitating unit 40 mounted to the upper end of the excavating bit 30.

As shown in FIGS. 3A and 3B, the upper twin nozzle 42 has therein the two injection paths defined by the partition body 56. Therefore, the air and water or the air and hardening agent are injected through the two injection paths of the upper twin nozzle 42 to the soil of the target ground having the bore. That is, the upper twin nozzle 42 injects two kinds of fluids at the same time to form two fluid jets.

At this time, the upper twin nozzle 42 injects the water or the hardening agent with the air to the soil of the target ground around the bore to enhance its injecting force, thus surely improving the ground.

As shown in FIG. 4, the lower twin nozzle 44 has the central path 46 which is axially defined through the center of the lower twin nozzle 44, and the pair of inclined outside paths 48 which are provided around the central path 46 to converge with the central path 46 at the outside end of the lower twin nozzle 44. In the lower twin nozzle 44, the cement hardening agent is injected through the central path 46, and the quick setting agent is injected through the pair of inclined outside paths 48. At this time, the gel time during the ground improvement work using the injection system 100 is indicated while the cement hardening agent and the quick setting agent pass through the nozzles of the injection rod 10. Thus, the cement hardening agent and the quick setting agent are rapidly hardened in the target ground after being injected into the soil of the ground. Therefore, the solid body can be formed in even the ground under water, without failure.

As shown in FIGS. 6 and 7, the lower twin nozzle 44 is integrally mounted to both the inner pipe 16 and the outer pipe 18 through which the cement hardening agent and the quick setting agent are fed to the lower twin nozzle 44. In the present invention, the lower twin nozzle 44 is tightly mounted to both the inner pipe 16 and the outer pipe 18 through a hook-type mounting or a screw-type mounting process.

The second agitating unit 50 has the horizontal nozzles 14 and 14a which horizontally injects the air to the outside of the injection rod 10. Therefore, the system 100 of the present invention forms the solid body in the target ground without any jamming of the injection rod 10 in the bore even when the injection rod 10 executes the ground improvement work in a deep bore of the ground. Furthermore, slime, generated during the ground improvement work, is easily removed by the air, injected from the horizontal nozzles 14 and 14*a*, from the bore of the target ground.

In the meantime, in the injection rod 10 of the system 100 according to the second embodiment of the present invention, the excavating bit 30*a* includes the longitudinal excavating bit body and the twisted wing part 62 provided around the bit body. The plurality of twin nozzles 42*a* are provided on the predetermined portions of the edge of the twisted wing part 62, thus injecting the desired materials to the outside of the injection rod in the different diagonal directions. Therefore, the excavating bits 30 and 30*a* of the systems 100 according to the first and second embodiments of the present invention may be selectively or alternatively used to execute a ground improvement work according to the physical properties of the target ground.

As described above, the present invention provides a rapid-set injection system using high-speed jet fluid, which has a structure capable of formation of a pile-shaped solid body in the target ground without causing any jamming of the injection rod in a bore of the ground even when the ground improvement work using the system is executed in a deep bore of the ground, and which efficiently removes slime generated during the ground improvement work, thus surely forming the solid body in the target ground. During the ground improvement work executed by the rapid-set injection system of the present invention, when the cement hardening agent and a quick setting agent are injected to the soil of the target ground through nozzles, a gel time is indicated while the cement hardening agent and the quick setting agent pass through the nozzles. Thus, the injected agents are rapidly hardened in the soil of the target ground. Therefore, the desired solid body is formed in even the ground under water with a fast current, without failure.

Although preferred embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A rapid-set injection system using high-speed jet fluid, conspiring:

an injection rod comprising one or more injection pipes to respectively feed air, a cement hardening agent and a quick setting agent in the injection rod, prior to injecting the air, the cement hardening agent and the quick setting agent to an outside of the injection rod, the injection rod further comprising:

an excavating bit provided at a lower portion of the injection rod to inject downward a fluid to the outside of the injection rod in criss-crossing diagonal directions, with a drill bit coupled to a lower end of the excavating bit;

a first agitating unit mounted to an upper end of the excavating bit to inject desired materials to the outside of the injection rod at different levers in different diagonal directions;

said first agitating unit including two twin nozzles diagonally disposed relative to the center axis of the injection rod; and a second agitating unit mounted to an upper end of the first agitating unit to horizontally inject air to the outside of the injection rod.

2. The system according to claim 1, wherein the excavating bit provided at the lower portion of the injection rod comprises:

a check valve provided at a central portion of the excavating bit; and one or more jet nozzles respectively disposed on the lower end of the excavating bit to inject downward the fluid to the outside of the injection rod in the criss-crossing diagonal directions.

3. The system of claim 2, wherein said one or more jet nozzles comprise at least three jet nozzles respectively disposed on said lower end of said excavating bit for injecting fluid from said rod in the downwardly, outwardly and criss-crossing diagonal directions.

4. The system according to claim 1, wherein said two twin nozzles in the first agitating unit comprise:

an upper twin nozzle provided at an upper portion of the first agitating unit to inject the air and water to the outside of the injection rod in a diagonal direction; and a lower twin nozzle provided under the upper twin nozzle it the first agitating unit to inject the cement hardening agent and the quick setting agent to the outside of the injection rod in another diagonal direction.

5. The system according to claim 4, wherein the upper twin nozzle has two injection paths therein defined by a partition body, thus injecting the air and water through the two injection paths to the outside of the injection rod.

6. The system according to claim 4, wherein the lower twin nuzzle includes:

a central path disposed parallel to and coaxial with a center axis of said nozzle, a pair of outside paths, each including an inlet, said outside paths being symmetrically disposed about the center axis of said nozzle and converging with said central path at an outside end of said lower twin nozzle;

said central path injecting the cement hardening agent.

7. The system according to claim 1, wherein the second agitating unit mounted to the upper end of the first agitating unit comprises:

a plurality of horizontal nozzles provided on predetermined portions of an outer casing of the second agitating unit, thus horizontally injecting the air to the outside of the injection rod.

* * * * *